US008365690B2

(12) United States Patent
Miettaux

(10) Patent No.: US 8,365,690 B2
(45) Date of Patent: Feb. 5, 2013

(54) HYDRAULICALLY OPERATED VALVE CONTROL SYSTEM AND INTERNAL COMBUSTION ENGINE COMPRISING SUCH A SYSTEM

(75) Inventor: Marc Miettaux, Genas (FR)

(73) Assignee: Renault Trucks, St. Priest (FR)

( * ) Notice: Subject to any disclaimer, the term of this patent is extended or adjusted under 35 U.S.C. 154(b) by 607 days.

(21) Appl. No.: 12/305,787

(22) PCT Filed: Jul. 4, 2006

(86) PCT No.: PCT/IB2006/002893
§ 371 (c)(1),
(2), (4) Date: Mar. 16, 2010

(87) PCT Pub. No.: WO2008/004020
PCT Pub. Date: Jan. 10, 2008

(65) Prior Publication Data

US 2010/0326382 A1 Dec. 30, 2010

(51) Int. Cl.
*F01L 9/02* (2006.01)

(52) U.S. Cl. ..... 123/90.12; 91/515

(58) Field of Classification Search ..... 123/90.12, 123/90.13, 90.22, 90.1, 90.23, 90.33; 91/515
See application file for complete search history.

(56) References Cited

U.S. PATENT DOCUMENTS

| | | | | |
|---|---|---|---|---|
| 2,643,664 | A * | 6/1953 | Willett | 137/101 |
| 6,257,183 | B1 * | 7/2001 | Vorih et al. | 123/90.12 |
| 6,360,728 | B1 * | 3/2002 | Sturman | 123/508 |
| 6,886,509 | B2 * | 5/2005 | Perez Cuadro | 123/90.12 |
| 7,500,466 | B2 * | 3/2009 | Noss et al. | 123/321 |
| 2010/0326382 | A1 * | 12/2010 | Miettaux | 123/90.12 |

FOREIGN PATENT DOCUMENTS

| | | | |
|---|---|---|---|
| EP | 0767295 | A1 | 4/1997 |
| EP | 1260680 | A2 | 11/2002 |
| EP | 1288489 | A | 3/2003 |
| JP | 09100706 | | 4/1997 |
| WO | 9836167 | A | 8/1998 |

OTHER PUBLICATIONS

International Search Report for corresponding International Application PCT/IB2006/002893.
Japanese Official Action (with translation) from corresponding Japanese Application 2009-517453.

* cited by examiner

*Primary Examiner* — Thomas Denion
*Assistant Examiner* — Daniel Bernstein
(74) *Attorney, Agent, or Firm* — WRB-IP LLP

(57) ABSTRACT

A hydraulically operated valve control system includes a hydraulic flow divider including a hydraulic valve adapted to distribute, between two lines feeding respectively to actuators coupled to two inlet or outlet valves of a cylinder, the flow of oil coming either from a source of oil under pressure or from the feeding lines. The oil flow is distributed between the two feeding lines on the basis of the ratio of oil flow-rates in these two lines.

12 Claims, 5 Drawing Sheets

$S_{117}$
$t_0$
$\Delta t_{117}$
$t$ $S_{118}$
$\Delta t_{118}$
$t$ $F_0$
$t$ $F_1$ $F_2$
$t$ $L_1$ $L_2$
$t$

HYDRAULICALLY OPERATED VALVE CONTROL SYSTEM AND INTERNAL COMBUSTION ENGINE COMPRISING SUCH A SYSTEM

BACKGROUND AND SUMMARY

This invention concerns an hydraulically operated valve control system for an internal combustion engine. It also concerns an internal combustion engine equipped with such a system.

Internal combustion engines are more and more equipped with multi-valve injection systems where two inlet valves and/or two exhaust valves are provided for each cylinder in order to optimize the flow of the air-fuel mixture or the exhaust gases to or from a combustion chamber. These sets of two valves must be driven in such a manner that the valves have parallel movements, that is the same lift and speed for both valves.

EP-A-O 736671 teaches the use of balancing springs which engage a piston fast with each valve in order to move each valve towards a closing position. Such an approach works if the friction forces for each valve and the rigidity of the two springs are identical and if the hydraulic feeding circuits are symmetrical. Such conditions cannot be guaranteed because of the tolerances in the fabrication of the valves, in the fabrication of the springs and in the distribution of the fluids circuits within a cylinder head. Therefore, it is not sure the two valves of the prior art actually have the same movements.

U.S. Pat. No. 5,619,965 discloses an arrangement for balancing valves in a hydraulic camless valve train. Valve position sensors are used in conjunction with an electronic control unit to pilot opening and closing of solenoid valves. Such an arrangement is complex and expensive since it requires sensors and solenoid valves dedicated to each inlet valve/exhaust valve of the engine.

It is desirable to provide an hydraulically operated valve control system which efficiently controls the movements of two valves, without requiring electronic sensors or other complex and expensive equipments.

An aspect of the invention concerns an hydraulic operated valve control system for an internal combustion engine having at least one cylinder provided with two valves driven with oil coming from a source of oil under pressure, each valve being controlled by an hydraulic actuator fed with oil under pressure through a respective feeding line. This system is characterized in that it includes an hydraulic flow divider comprising an hydraulic valve adapted to distribute the flow of oil coming either, from said source or from said two feeding lines between said two feeding lines, depending on the ratio of oil flow-rates in these two lines.

Thanks to an aspect of the invention, the hydraulic valve can evenly distribute oil to the two inlet valves or two exhaust valves when these valves are supposed to be lifted.

Similarly, when the valves are supposed to be closed, the flow divider of the system of the invention accommodates evenly the two flows coming from the two inlet or exhaust valves.

According to further aspects of the invention, the control system might incorporate one or several of the following features:

The hydraulic valve comprises a valve member which is movable depending on pressure drops created across two throttles located respectively in a connecting line between said source and one of the feeding lines.

The valve member is automatically moved towards a position of balance of the pressure drops across these throttles.

The valve member is advantageously movable in a valve body which is defines a bore, where the valve member is slidably movable and which forms an internal volumes where oil under pressure acts on the valve member in order to move it in translation along a longitudinal axis, these volumes being fluidically connected to the connecting lines either upstream or downstream of the throttles.

The hydraulic valve body defines four internal volumes, two internal volumes being fluidically connected to a first connecting line in fluid connection with a first valve, respectively upstream and downstream of a first throttle located in this first connecting line, whereas the other two internal volumes are fluidically connected to a second connecting line in fluid connection a second valve, respectively upstream and downstream of a second throttle located in the second connecting line.

The pressure within the internal volume connected to the first connecting line upstream of the first throttle and the pressure within the internal volume connected to the second connecting line downstream of the second volume tend to move the valve member in a first direction along the longitudinal axis of the bore, whereas the pressure within the internal volume connected to the first connecting line downstream of the first throttle and the pressure within the internal volume connected to the second connecting line upstream of the second throttle tend to move the valve member in a second direction opposite the first direction.

According to a first embodiment of the invention, the throttles are each provided on a shuttle movable between two positions, depending on the direction of oil flow in the feeding lines. In such a case, the internal volumes of the hydraulic valve body are advantageously connected to the feeding lines upstream or downstream of the corresponding throttle, irrespective the position of the shuttles.

According to another embodiment of the invention, the throttles are provided on fixed part of the connecting lines, check valves being respectively provided between the internal volumes of the hydraulic valve body and the throttles.

The flow divider also includes two solenoid valves connecting selectively the hydraulic valves respectively to the source of oil under pressure and to a low pressure circuit.

An aspect of the invention also concerns an internal combustion engine provided with a control system as mentioned here above.

BRIEF DESCRIPTION OF THE DRAWINGS

The invention will be better understood on the basis of the following description, which is given in correspondence with the annexed figures as an illustrative example, without restricting the object of the invention. In the annexed figures.

DETAILED DESCRIPTION

Figure 1:
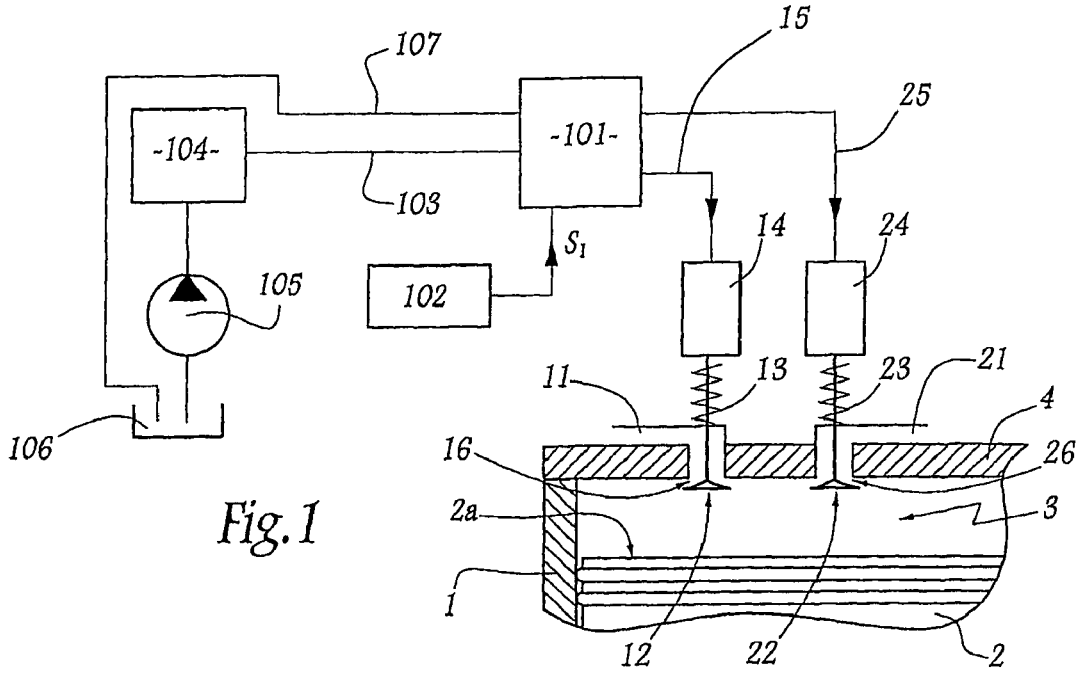
FIG. 1 is a schematic view of an internal combustion engine according to the invention comprising a control system according to the invention.

The camless internal combustion engine E schematically represented on FIG. 1 comprises several cylinders. One cylinder 1 is partly represented and a piston 2 is slidably movable within cylinder 1. A combustion chamber 3 is defined between a front face 2*a* of piston 2 and cylinder head 4. Two inlet ducts 11 and 21 are mounted on cylinder head 4 to feed combustion chamber 3 with fuel. The flow of fuel within ducts 11 and 21 is controlled by two inlet valves 12 and 22 urged to a closed position by two springs 13 and 23 and piloted each by an hydraulic actuator 14 or 24.

Each actuator 14 or 24 is fed with oil under pressure through a respective feeding line 15 or 25. A hydraulic flow divider 101 is provided to selectively provide actuators 14 and 24 with oil under pressure, when it is necessary to open valves 12 and 22.

Divider 101 is piloted by an electronic control unit 102 and fed with oil under pressure via a main feeding line 103 which comes from a filtration unit 104 fed by a pump 105 pumping oil in a sump 106. A main exhaust line 107 conveys oil from divider 101 back to sump 106.

Oil coming from pump 105 has a pressure between about 70 and about 210 bars.

Figure 2:
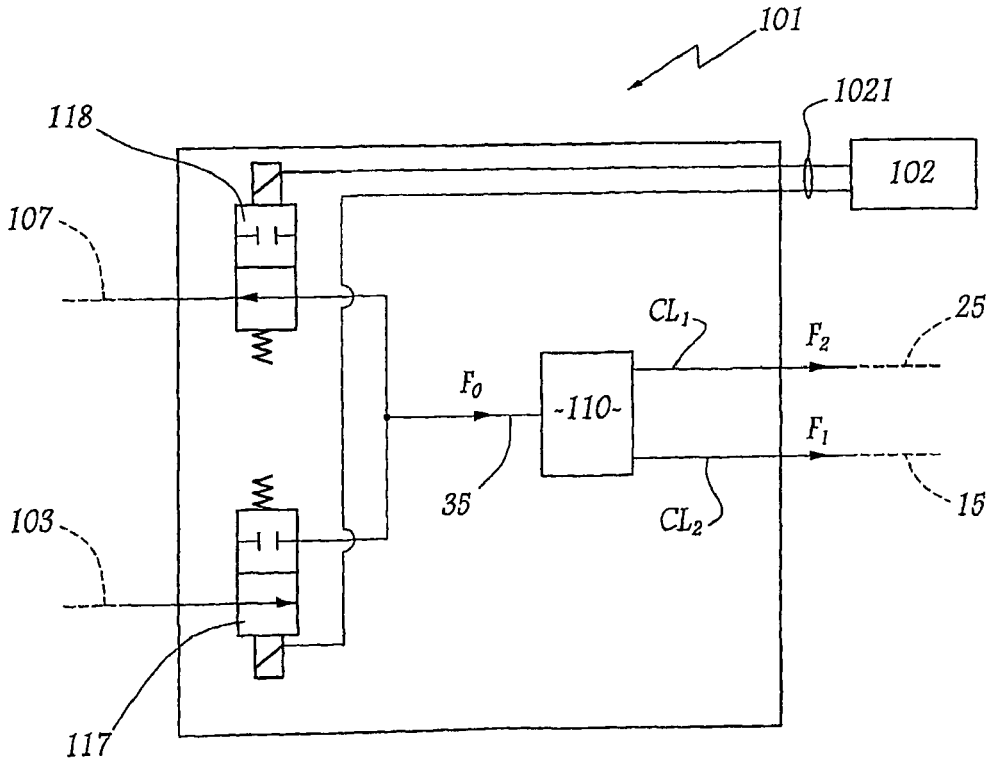
FIG. 2 is a schematic view of the flow divider and electronic control unit of the control system of the engine of FIG. 1.

Cylinder 1 is provided with some other non represented valves, at least an exhaust valve. When it is desired to open valves 12 and 22, electronic control unit 102 sends to flow divider 101, an electric signal S-i, via an electric line 1021. Flow divider 101 converts this signal into a double pressure hydraulic signal $S_{12}$, $S_{22}$ adapted to control actuators 14 and 24 in order to lift valves 12 and 22 with respect to their respective seats 16 and 26. As shown on FIG. 2, flow divider 101 comprises an hydraulic valve 110 connected to line 103 via a first solenoid valve 117 and to line 107 via a second solenoid valve 118. When they are not activated, valves 117 isolates hydraulic valve 110 from main feeding line 103 and valve 118 connects hydraulic valve 110 to main exhaust line 107. The outlet port of valve 117 and the inlet port of valve 118 are respectively connected to hydraulic valve 110 via a common line 35.

When solenoid valve 117 is activated to allow communication between line 103 and valve 110, a main flow of oil under pressure flows from line 103 to hydraulic valve 110 with a flow-rate $F_0$. This flow-rate is divided by hydraulic valve 110 into two secondary flow-rates Fi and $F_2$ which convey respectively hydraulic signal $S_{12}$ and $S_{22}$.

Figures 3A, 3B, 3C, 3D, 3E:
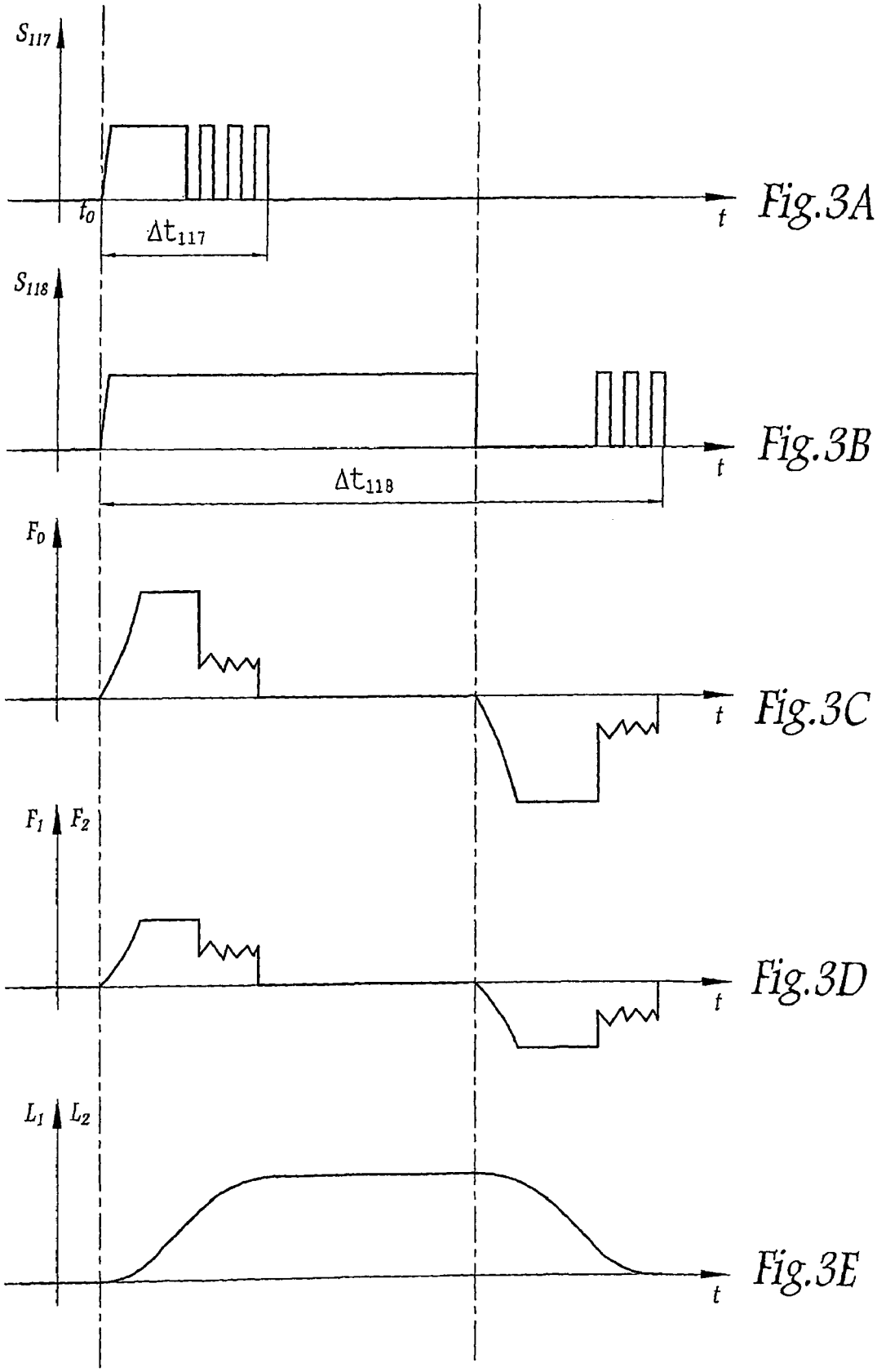
FIGS. 3A to 3E show variations of some physical values, as a function of time, when the control system is being operated.

Referring now to FIG. 3, several variations of parameters with respect to time should be considered. FIG. 3A shows the part of electrical signal Si sent by unit 102 to solenoid valve 117 as a function of time t. One notes $Sn_7$ this part of signal. Similarly, FIG. 3B shows, as a function of time t, the part of signal Sna sent to solenoid valve 118. Signals $Sn_7$ and Sue are sent from an instant $t_0$, respectively for a first period of time $\delta tn_7$ and for a second period time $\delta t\text{-}n_8$.

FIG. 3C shows the flow-rate $F_0$ in line 35 as a result of the opening and closing of solenoid valves 117 and 118. $F_0$ is positive when oil flows from valve 117 to valve 110 and negative when oil flows from valve 110 to valve 118.

FIG. 3D shows the values of flow-rates Fi and $F_2$ in lines 15 and 25, respectively. These values are kept substantially identical, as explained here-under.

Finally, FIG. 3E shows, the lifts Lu and $L_{12}$ of valves 11 and 12 as a result of flow-rates Fi and $F_2$. In order that lifts $L_{11}$ and $Li_2$ are identical or superimposed on FIG. 3E, that is in order to have parallel movements of valves 11 and 12, flow-rates Fi and $F_2$ must be substantially identical.

Figure 4:
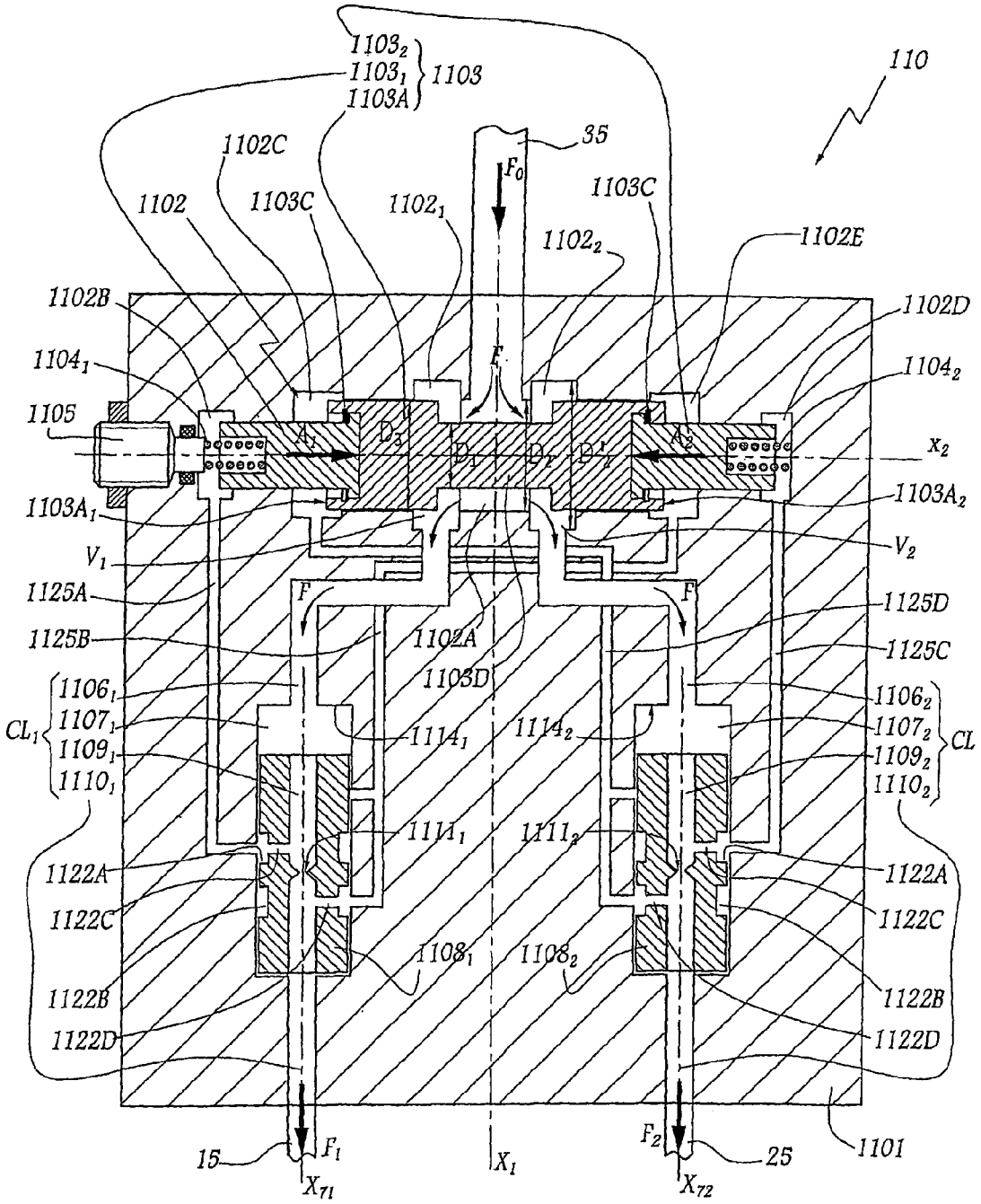
FIG. 4 is a schematic view of a hydraulic valve belonging to the flow divider of FIG. 2 in a first configuration of work.
Figure 5:
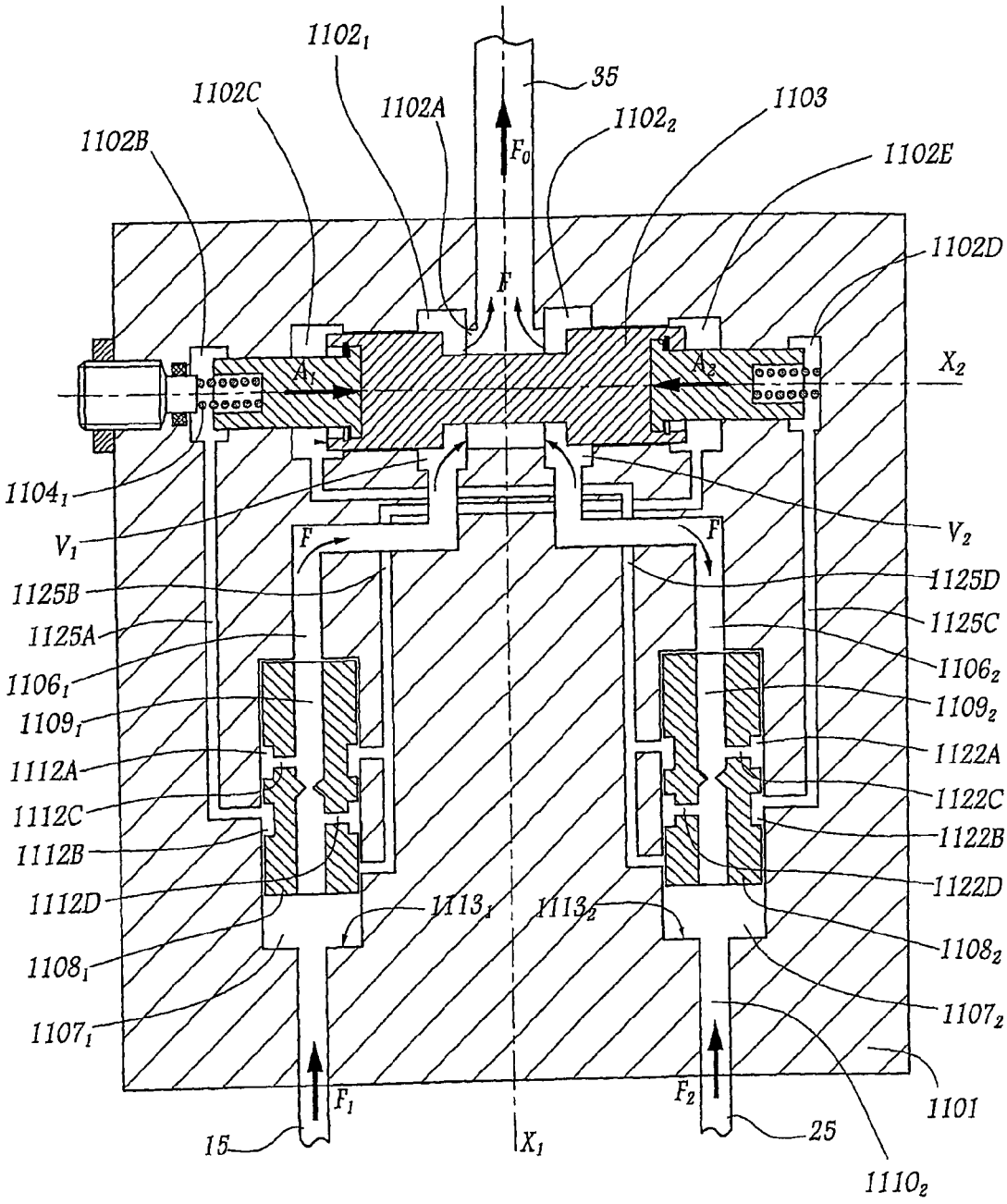
FIG. 5 is a view similar to FIG. 4 when the valve is in a second configuration of work.

In order to obtain such identical flow-rates Fi and $F_2$, hydraulic valve 110 is constituted as shown on FIGS. 4 and 5. Valve 110 comprises a valve body 1101 which defines a main bore 1102 extending along the direction of an axis $X_2$. A valve member 1103 in the form of a spool is slidably mounted within bore 1102 and comprises a main portion 1103A and two lateral portions 1103-*j* and $\mathbf{1103}_2$, axially secured to main portion 1103A thanks to two locking rings 1103B and 1103C. Within bore 1102, spool 1103 is compressed between two springs 1104*i* and $\mathbf{1104}_2$ which tend to return spool 1103 to a central position within bore 1102. It is possible to adjust the central position of spool 1103 within bore 1102 thanks to an adjusting screw 1105 which defines the reference surface of spring $\mathbf{1104}_1$ on its side opposite to spool 1103.

Main portion 1103A comprises a central rod 1103D whose diameter Di is significantly smaller than the diameter $D_2$ of the central part 1102A of bore 1102 which communicates with line 35. On either sides of part 1102A, bore 1102 is provided with two grooves 1102-ι and $\mathbf{1102}_2$ whose diameter $D'_2$ is substantially larger than the maximum diameter $D_3$ of spool 1103. One notes Vi the volume of groove 1102-ι and of the part of bore 1102 which surrounds central rod 1103D at the axial level of this groove. One notes $V_2$ the volume of groove $\mathbf{1102}_2$ and the portion of bore 1102 which surrounds rod 1103D at the axial level this groove.

Depending on the position of spool 1103 along axis $X_2$, volume Vi is smaller, equal or larger than volume $V_2$. More precisely, volumes $V_1$ and $V_2$ are substantially equal on FIG. 4 and, if spool 1103 moves towards the left on this figure, volume $V_1$ becomes larger than volume $V_2$.

Volumes Vi and $V_2$ are fed with oil under pressure by the oil flow, as shown by arrows F, when solenoid valve 111 is activated. Around rod 1103D, the main flow of oil, having flow-rate $F_0$, divides itself into two secondary flows having each a flow-rate Fi or $F_2$. These flow-rates follow the following equation $$F_0=F_1+F_2$$

A first conduit $\mathbf{1106}\text{-}_1$ connects volume $V_1$ to a bore $\mathbf{1107}\text{-}_1$ where a shuttle $\mathbf{1108}\text{-}_1$ is movable along a longitudinal axis $X_{71}$ of bore $\mathbf{110}T_1$. Shuttle $\mathbf{1108}\text{-}_1$ is provided with a central longitudinal bore 1109-1 which defines a canal for the flow of oil F coming from line 1106*i*. This oil flow exits bore 1107*i* through an exhaust conduit $\mathbf{111}O_1$ which is connected to line 15.

A throttle $\mathbf{1111}_1$ is defined within central bore $\mathbf{1109}_1$ and this throttle creates a pressure drop in bore 1109-ι when oil flows from conduit 11061 towards conduit 1110*i*

Similarly, a conduit $\mathbf{1106}_2$ leads from volume $V_2$ to a bore $\mathbf{1107}_2$ where a shuttle $\mathbf{1108}_2$ is slidably movable along a longitudinal axis $X_{72}$ of this bore. Bore $\mathbf{1107}_2$ is connected by an exhaust conduit $\mathbf{1110}_2$ to line 25. A throttle $\mathbf{1111}_2$ is defined in a central bore $\mathbf{1109}_2$ of shuttle $\mathbf{1108}_2$. Conduit $\mathbf{1106}_1$ bores $\mathbf{1107}_1$ and $\mathbf{1109}_1$ and conduit $\mathbf{1110}_1$ form together a connecting line CU between bore 1102 and feeding line 15. Similarly, conduits $\mathbf{1106}_2$ and 111 $O_2$ and bores $\mathbf{1107}_2$ and $\mathbf{1109}_2$ form together a connecting line $CL_2$ between bore 1102 and line 25.

Four hydraulic chambers are defined in bore 1102 around spool 1103.

A first chamber 1102B is defined between portion 1103*i* and screw 1105.

A second chamber 1102C is defined around portion 1103*i* and is limited by a first end surface 1103Ai of portion 1103A. Pressure within chambers 1102B and 1102C acts on the end surface of portion 110$S_1$ and on surface 1103Ai to push spool 1103 against the action of spring 1104$_2$, that is towards to right on FIG. 4, in the direction of arrow $A_1$.

A third chamber 1102D is defined around the free end of lateral portion 1103$_2$ and a fourth chamber 1102E is defined around portion 1103$_2$ and limited by a second end surface 1103$A_2$ of portion 1103. Pressure within chambers 1102D and 1102E tends to push spool 1103 against the action of spring 1104-$_\iota$ that is towards the left on FIG. 4, in the direction of arrow $A_2$.

Chambers 1102B and 1102D, on the one hand, and chambers 1102C and 1102E, on the other hand, are symmetrical with respect to a central axis Xi of body 1101. Shuttle 1108*i* is provided with a first external groove 1112A and a second external groove 1112B offset axially with respect to groove 1112A. Groove 1112A is connected to central bore 1109*i* via a first canal 1112C, whereas groove 1112B is connected to central bore 1109*i* via a second canal 1112D. Canals 1112C and 1112D are located on either sides of throttle 1111$_1$. Similarly, shuttle 1108$_2$ is provided with two external grooves 1122A and 1122B and two canals 1122C and 1122D located axially on either sides of throttle 1111$_2$.

When oil flows from solenoid valve 117 to actuators 14 and 24, oil coming from volumes Vi and $V_2$ through lines 1106*i* and 1106$_2$ tends to push shuttles 1108*i* and 110$S_2$ in the position of FIG. 4 where these shuttles lie against first end walls 1113*i* and 1113$_2$ of these bores 1107*i* and 1107$_2$, next to conduits 1110*i* and 1110$_2$.

In this configuration, groove 1112A is aligned with the outlet of a conduit 1125A which extends between bore 1107*i* and chamber 1102B. Similarly, groove 1112B is located in front of one of the two outlets of a conduit 1125B which connects bore 1107*i* to chamber 1102E.

A third conduit 1125C has its outlet located in front of groove 1122A when shuttle HO8$_2$ is in the position of FIG. 4 and connects bore 1107$_2$ to chamber 1102D. Finally, a fourth conduit 1125D has two outlets in bore 1107$_2$, one of these outlets being located at the level of groove 1122B in the configuration of FIG. 4. Connecting line 1125D connects bore 11 $QT_2$ to chamber 1102C.

One considers that, apart from pressure drops at throttles 1111$_1$ and 1111$_2$, pressure drops within valve 110 and actuators 14 and 24 are negligible with respect to the oil pressure values delivered by pump 105.

The construction of hydraulic valve 110 is such that flow-rates Fi and $F_2$ are automatically adjusted to be equal, so that actuators 14 and 24 are driven in the same manner.

One notes R the ratio of flow-rates Fi and $F_2$ which follows equation:

$$R=F1/F2$$

Because of the construction of valve 110, flow-rate. $F_1$ is the same in connecting line $CL_1$ and in feeding line 15. Similarly, flow-rate $F_2$ is the same in connecting line $CL_2$ and feeding line 25.

Considering the configuration of FIG. 4 where oil is supposed to flow from line 35 to lines 15 and 25, if more oil flows in line 1106$_1$ than in line 1106$_2$, that is if R is larger than 1, then pressure drop at the level of throttle 1111$_1$ is higher than pressure drop at the level of throttle 1111$_2$. Under such circumstances, the pressure difference between the pressures in chambers 1102B and 1102E is larger than the pressure difference between the pressure in chambers 1102D and 1102C. The geometry of spool 1103 is such that the end surface of portion 1103$_1$, perpendicular to axis $X_1$, which undergoes the pressure in chamber 1102B, has substantially the same area as surface 1103$A_1$ which undergoes the pressure in chamber 1102C. Similarly, the end surface of portion 1103$_2$ has the same area as surface 1103$A_2$ which undergoes the pressure within chamber 1102E. Therefore, because of the pressure differences between chambers 1102B and 1102E, on the one hand, and 1102D and 1102$C_1$ on the other hand, spool 1103 is pushed to the right of FIG. 4 in direction of arrow $A_1$, that is against the action of spring 1104$_2$. This implies that volume $V_1$ decreases, whereas volume $V_2$ increases so that the cross section of volume $V_1$ available for oil flow $F_1$ becomes smaller than the cross section of volume $V_2$ available for oil flow $F_2$. This implies that flow-rate $F_1$ in line 1106-$_1$ decreases and flow-rate $F_2$ in line 1106$_2$ increases. Therefore, ratio R decreases up to when it reaches value "1".

If flow-rate $F_2$ tends to be larger than flow-rate $F_1$, that is if R is smaller than 1, the pressure differences work in the other way, so that spool 1103 is moved to the left on FIG. 4 in the direction of arrow $A_2$ and the cross section of volume $V_2$ available for flow-rate $F_2$ decreases whereas the cross section of volume $V_1$ available for flow-rate $F_1$ increases, so that R increases up to when it reaches the values "1".

Therefore, hydraulic valve 110 evenly distributes flow-rate $F_0$ into two substantially equal flow-rates $F_1$ and $F_2$ whose ratio R equals "1" or is automatically adjusted to "1", so that actuators 14 and 24 are driven in the same way.

In the configuration where oil flows from actuators 14 and 24 towards main exhaust line 107 and sump 106, that is when inlet valves 12 and 22 are being closed, the flow of oil within bores 1107-1 and 1107$_2$ is such that shuttles 1108$_1$ and 1108$_2$ are moved away from lines 15 and 25, as shown in FIG. 5. In this configuration, shuttles 1108*i* and 1108$_2$ lie respectively against second end walls 1114$_1$ and 1114$_2$ of bores 1107$_1$ and 1107$_2$ on the sides of lines 1106$_1$ and 1106$_2$, that is opposite lines 15 and 25.

Because of this movement of the shuttles, groove 1112B is connected by conduit 1125A to chamber 1102B. On the other hand, groove 1112A is connected via conduit 1125B to chamber 1102E. Thanks to canals 1112C and 1112D, chamber 1112B is at the pressure within central bore 1109$_1$ upstream of throttle 1111$_1$, whereas chamber 1102E is at the pressure within central bore 1109$_1$ downstream of throttle 1111$_1$. In other words, even if the oil flow direction within lines 15 and C1_*i* is reverse with respect to the situation of FIG. 4, the pressure difference between chambers 1102B and 1102E measures the pressure drop at the level of throttle 1111$_1$, as in the configuration of FIG. 4. Similarly, the pressure difference between chambers 1102 D and 1102C measures the pressure drop across throttle 1111$_2$.

As explained for the configuration of FIG. 4, in case more oil flows in line 15 than in line 25, that is when R is larger than 1, the pressure drop across throttle 1111-$_1$ becomes bigger than the pressure drop across throttle 1111$_2$. Therefore, that the pressure differences between chambers 1102B and 1102E, on the one hand, 1102D and 1102C, on the other hand, act on spool 1103, so that it is moved to the right on FIG. 4 in the direction of arrow A-i, which partially closes volume \λ and decreases flow F-i. Therefore, R decreases to value "1" and flow-rates $F_1$ and $F_2$ are substantially equal.

In case the pressure drop across throttle 1111$_2$ is greater than the pressure drop across throttle 1111$_1$, spool 1103 is moved to the left of FIG. 5, in the direction of arrow $A_2$ and R increases to value "1"

Figure 6:
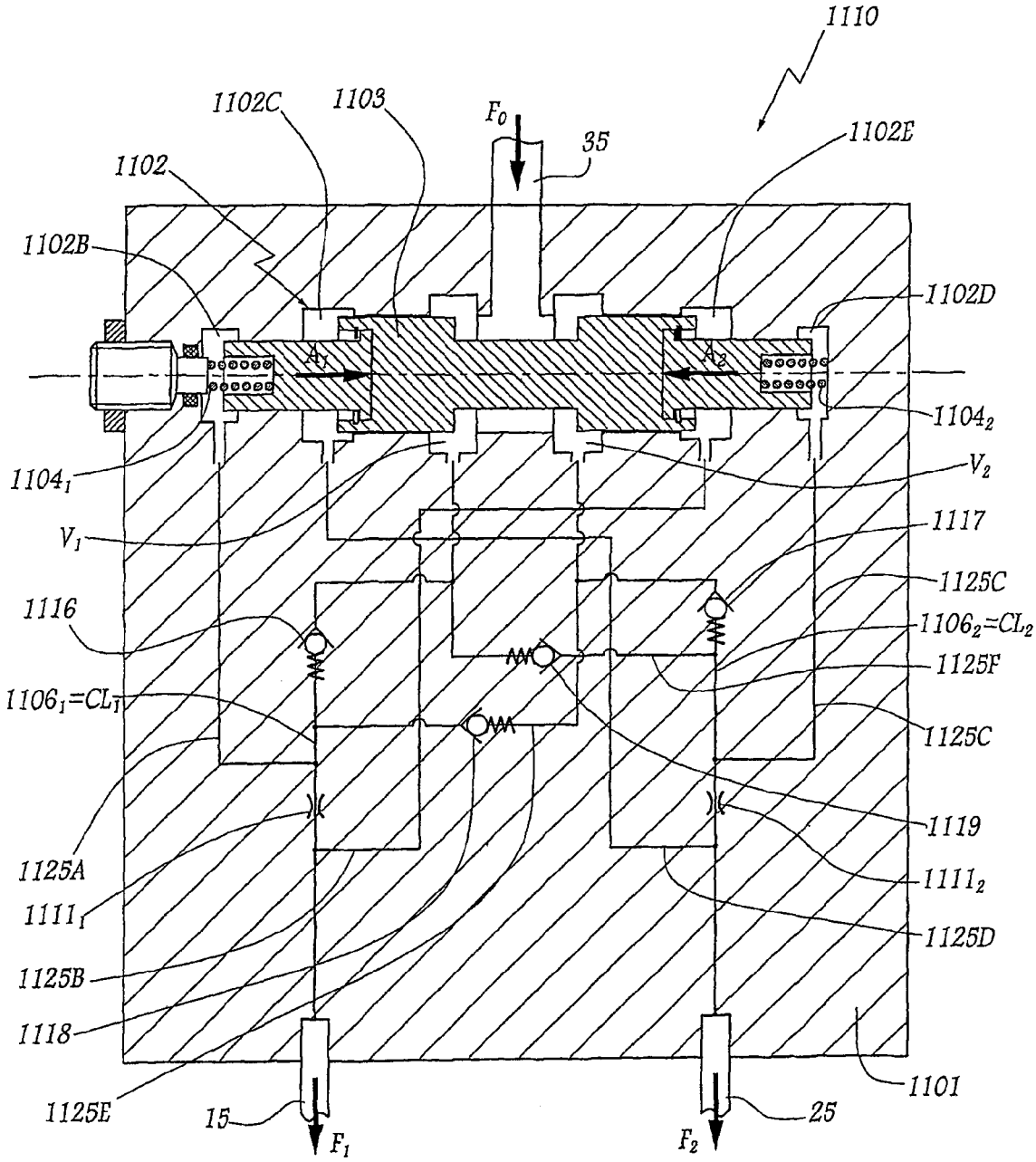
FIG. 6 is a view similar to FIG. 4 for a valve according to a second embodiment of the invention.

In the second embodiment of FIG. 6, the same elements as in the first embodiment have the same references. The upper part of hydraulic valve 110 is the same as in the first embodiment. A valve spool 1103 is slidably mounted within a bore 1102 provided in a valve body 1101 and defining four chambers 1102B, 1102C, 1102D and 1102E. No shuttle is used in this embodiment and two throttles 1111$_1$ and 1111$_2$ are provided on fixed portions of two conduits 1106$_1$ and 1106$_2$ between volumes $V_1$ and $V_2$ and feeding lines 15 and 25.

Conduits 1106$_1$ and 1106$_2$ constitute each a connecting line $CL_1$, respectively $CL_2$, between bore 1102 and feeding line 15, respectively 25. A first check valve 1116 is provided on connection line $CL_1$ between bore 1102 and throttle 1111$_1$. It allows oil flow only from bore 1102 to throttle 1111$_1$. A first conduit 1125A connects conduit 1106$_1$, between check valve 1116 and throttle 1111$_1$, to chamber 1102B. A second conduit 1125B connects conduit 1106*i*, between line 15 and throttle 1111$_1$, to chamber 1102E. Similarly, a third conduit 1125C connects chamber 1102D to conduit 1106$_2$, between volume $V_2$ and throttle IIH2, and a fourth conduit 1125D connects chamber 1102C to conduit 1106$_2$ between line 25 and throttle 1111$_2$.

Conduit 1106$_2$ is provided with a check valve 1117 located between volume $V_2$ and throttle 1111$_2$. Check valve 1117 allows oil flow only from bore 1102 to throttle A fifth conduit 1125E connects conduit 1106$_1$, between check valve 1116 and throttle 1111$_1$, to conduit 1106$_2$, between check valve 1117 and volume $V_2$. Another check valve 1118 is mounted on conduit 1125E and allows oil to flow only from line 1106-$_1$ to line 1106$_2$.

A sixth conduit 1125F connects conduit 1106$_{21}$ between check valve 1117 and throttle 1111$_2$, to conduit 11$Oe_1$, between volume $V_1$ and check valve 1116. Another check valve 1119 is mounted on conduit 1125F and allows oil flow only from conduit 1106$_2$ to conduit 1106$_1$.

In case oil flows from line 35 to lines 15 and 25, volumes V1 and $V_2$ are connected to throttles 1111$_1$ and 1111$_2$ respectively through check valves 1116 and 1117. If, for instance, ratio R defined as above is higher than 1, that is if flow-rate $F_1$ in line 15 is larger than flow-rate $F_2$ in line 25, the pressure drop across throttle 111$I_1$ is higher than the pressure drop across throttle 1111$_2$. Then the pressure differences sensed through conduits 1125A, 1125B on the one side, 1125C and 1125D, on the other side, are such that spool 1103 is moved to the right on FIG. 6, in the direction of arrow A-t, against the action of a return spring 1104$_{21}$ which decreases volume $V_1$, its corresponding cross section and the flow in line 1106-t, so that the differences between flow-rates Fi and $F_2$ decreases. Therefore, ratio R decreases up to value Similarly, spool is moved to the left on FIG. 6 in the direction of arrow $A_2$, against the action of a return spring 1104-$_1$, if flow $F_2$ is larger than flow $F_1$, that is if ratio R is smaller than 1. So, flow-rate $F_2$ decreases and flow-rate Fi increases and ratio R increases up to value "1".

In the case of oil flow from lines 15 and 25 to line 35, that is in a configuration corresponding to FIG. 5 for the first embodiment, oil flows from throttle 111$I_1$ to volume $V_2$ through conduit 1125E. Similarly, oil flows from throttle 1111$_2$ to volume $V_1$ through conduit 1125F. In case the pressure drop across throttle 1111$_1$ is higher than the pressure drop across throttle 1111$_2$, this difference is sensed through conduits 1125A, 1125B$_1$ 1125C and 1125D, which induces that spool 1103 moves to the left of FIG. 6 in the direction of arrow $A_2$, which decreases volume $V_2$ and increases volume $V_1$, so that the differences between the flow-rates $F_1$ and $F_2$ is reduced.

Throttles 1111$_1$ and 1111$_2$ have been represented in connecting lines $CL_1$ and $CL_2$ which are different from feeding lines 15 and 25. However, connecting lines $CL_1$ and $CL_2$ could be parts of lines 15 and 25.

The invention has been described when used to control two inlet valves 11 and 12 of a cylinder. It may also be used to control exhaust valves.

In both embodiments described, the valve member 1103 is subject to a first force proportional to the flow in one feeding line, this first force acting along a first direction. The valve member is also subject to a second force proportional to the flow in the other feeding line, this second force acting along an opposite direction. These forces are due to the pressure acting on the relevant surfaces of the valve member. The valve member has a flow directing portion which directs the incoming flow to the two feeding lines which is proportional to an offset compared to a centre position where it delivers the same flow to both feeding lines. The balance of the two forces move the valve member in a direction where its flow directing portion will correct an unbalance in the two flows, by a negative feedback relationship. An overpressure (or overflow) in one feeding line will tend to force the valve member in a direction where it will restrict the flow in that feeding line.

Each first and second force is directly derived from the pressure difference on both sides of a throttle in the corresponding feeding line. Such force is created by directing a pressure collected upstream of the throttle on one side of a piston, and directing a pressure collected downstream of the throttle to the other side of the piston, said piston being in fact formed by two opposite surfaces of the valve member. The first and the second force are therefore each function of the difference between the actions of the upstream pressure and the downstream pressure for their respective throttle.

In the first embodiment, the shuttles act as circuit inverters to switch the connections between the pressure collecting points on both sides of the throttle, so that the upstream pressure and the downstream pressure always act on the same side of the piston, irrespective of the direction of flow across the throttle. This means that whatever the sign of the pressure difference across one throttle (which is positive for one flow direction and negative for the other flow direction), the valve member will tend to be displaced in the same direction when considering the action of one the first or second force. In the second embodiment, contrary to the first embodiment, the valve member will tend to be displaced in opposite directions when considering the action of one of the first or second force, depending on the direction of low through the corresponding throttle. Therefore, in the second embodiment, the check valves switch the connections between the flow directing portion of the valve member and the two feeding lines, so that they are inverted. This allows that, although the displacement of the valve member will depend on the sign of an overpressure (or over-flow) in one feeding line, the resulting displacement will nevertheless be a flow restriction in the feeding line which has the strongest flow in absolute value.

LIST OF REFERENCES

1 cylinder
2 piston
2*a* front face
3 combustion chamber
4 cylinder head
11, 21 inlets ducts

12, 22 inlet valves
13, 23 springs
14, 24 hydraulic actuators
15, 25 feeding line
16, 26 seats
35 common line
101 hydraulic flow divider
102 electronic control unit
1021 electric line
103 main feeding line
104 filtration unit
105 pump
106 sump
107 main exhaust line
110 hydraulic valve
1101 valve body
1102 bore
1102A central part
1102$_1$ groove
1102$_2$ groove
1102B chamber
1102C chamber
1102D chamber
1102E chamber
1103 valve member or spool
1103A main portion
1103A$_1$ end surface
1103A$_2$ end surface
1103$_1$ lateral portion
1103$_2$ lateral portion
1103B locking ring
1103C locking ring
1103D central rod
1104$_1$ spring
1104$_2$ spring
1105 adjusting screw
1106$_1$, conduit
1106$_2$ conduit
1107$_1$ bore
1107$_2$ bore
1108$_1$ shuttle
1108$_2$ shuttle
1109$_1$ central bore
1109$_2$ central bore
1110$_1$ exhaust conduit
1110$_2$ exhaust conduit
1111$_1$ throttle
1111$_2$ throttle
1112A external groove
1112B external groove
1112C canal
1112D canal
1113$_1$ first end wall of bore 1107$_1$
1113$_2$ first end wall—of bore 1107$_2$
1114$_1$ second end wall of bore 1107$_1$
1114$_2$ second end wall of bore 1107$_2$
1122A external groove
1122B external groove
1122C canal
1122D canal
1125A conduit
1125B conduit
1125C conduit
1125D conduit
1125E conduit
1125F conduit
1116 check valve
1117 check valve
1118 check valve
1119 check valve
117 solenoid valve
118 solenoid valve
$A_1$ arrow
$A_2$ arrow
$CL_1$ connecting line
$CL_2$ connecting line
$D_1$ diameter of 1103D
$D_2$ diameter of central part of 1102
$D'_2$ diameter of 1102$_1$ and 1102$_2$
$D_3$ diameter of 1103
E engine
F arrows (oil flow)
$F_0$ flow-rate in line 35
$F_1$ flow-rate in line 15
$F_2$ flow-rate in line 25
$L_{11}$ lift of valve 11
$L_{12}$ lift of valve 12
R ratio $F_1/F_2$
$S_1$ electrical signal
$S_{12}$ hydraulic signal
$S_{22}$ hydraulic signal
$S_{117}$ part of signal $S_1$
S-118 part of signal $S_1$ t time to instant
$\delta t_{117}$ period of time
$\delta t_{118}$ period of time
$V_1$ volume of 1102$_1$
$V_2$ volume of 1102$_2$
$X_1$ axis of body 1101
$X_2$ axis of body 1102
$X_{71}$ axis of 1107$_1$
$X_{72}$ axis of 1107$_2$

The invention claimed is:

1. A hydraulically operated valve control system for an internal combustion engine having at least one cylinder provided with two valves driven with oil coming from a source of oil under pressure, each valve being controlled by a hydraulic actuator fed with oil under pressure through a respective feeding line, the control system comprising a hydraulic flow divider comprising a hydraulically actuated hydraulic valve adapted to distribute the flow of oil coming either from the source or from the feeding lines between the two feeding lines, depending on the ratio of oil flow-rates in the two feeding lines, the hydraulic valve comprising a valve member that is movable in a hydraulic valve body, the hydraulic valve body defining a bore where the valve member is slidably movable and which forms internal volumes where oil under pressure acts on the valve member in order to move it along a longitudinal axis of the bore, the valve member being movable depending on pressure drops created across two throttles, each throttle of the two throttles being disposed in a respective connecting line between the source and one of the feeding lines, each of the internal volumes being fluidically connected to the connecting lines either upstream or downstream of the throttles, the hydraulic valve body defining four internal volumes, two internal volumes being fluidically connected to a first connecting line in fluid connection with a first valve, respectively upstream and downstream of a first throttle located in the first connecting line, whereas the other two internal volumes are fluidically connected to a second connecting line in fluid connection with a second valve, respectively upstream and downstream of a second throttle located in the second connecting line.

2. A system according to claim 1, wherein the valve member is automatically moved towards a position in which the pressure drops across the throttles are balanced.

3. A system according to claim 1, wherein the pressure within the internal volume connected to the first connecting line upstream of the first throttle and the pressure within the internal volume connected to the second connecting line ($CL_2$) downstream of the second throttle tend to move the valve member in a first direction along the longitudinal axis, whereas the pressure within the internal volume connected to the first connecting line downstream of the first throttle and the pressure within the internal volume connected to the second line upstream of the second throttle tend to move the valve member in to second direction opposite the first direction.

4. A system according to claim 1, wherein the throttles are each provided on a shuttle movable between two positions, depending on the direction of oil flow in the feeding lines.

5. A system according to claim 1, wherein the throttles are each provided on a shuttle movable between two positions, depending on the direction of oil flow in the feeding lines, and wherein the internal volumes are connected to the connecting lines upstream or downstream of the corresponding throttle irrespective of the position of the shuttles.

6. A system according to claim 1, wherein the throttles are provided on fixed parts of the connecting lines, check valves being respectively provided between the internal volumes and the throttles.

7. A system according to claim 6, wherein volumes of the internal volumes vary depending on a position of the valve member.

8. A system according to claim 1, wherein the flow divider also includes two solenoid valves connecting selectively the hydraulic valve respectively to the source of oil under pressure and to a low pressure circuit.

9. An internal combustion engine provided with a control system according to claim 1.

10. A hydraulically operated valve control system for an internal combustion engine having at least one cylinder provided with two valves, each valve being controlled by a hydraulic actuator fed with oil under pressure through a respective feeding line, the control system comprising:

a source of hydraulic fluid;

a hydraulic flow divider connected to the source of hydraulic fluid;

first and second feeding lines connected at one end to at one end to a respective outlet of the hydraulic flow divider, and, at another end, to respective hydraulic actuators of the two valves, the first and second feeding lines each having a throttle and a first line connected upstream of the throttle and a second line connected downstream of the throttle;

the hydraulic flow divider comprising a hydraulically actuated hydraulic valve comprising a valve member that is slidably movable in a bore of a hydraulic valve body, the valve member comprising a first piston portion and a second piston portion, the first and second piston portions being connected by a connecting portion having a smaller diameter than the first and second piston portions, the valve member and the bore defining first and second inner and first and second outer internal volumes on opposite sides of the first and second piston portions, wherein the first lines of the first and second feeding lines communicate with the second and the first outer internal volumes, respectively, and the second lines of the first and second feeding lines communicate with the second and the first internal volumes, respectively, so that the valve member moves in response to a difference in flow between the first and second feeding lines to restrict flow in a higher flow one of the first and second feeding lines.

11. The system of claim 10, wherein the valve member is movable in the bore from a central position which the valve member provides an equal restriction to flow in the first and second feeding lines to a plurality of offset positions in which it increases a flow restriction in one or the other of the first and second feeding lines.

12. A hydraulically operated valve control system for an internal combustion engine having at least one cylinder provided with two valves, each valve being controlled by a hydraulic actuator fed with oil under pressure through a respective feeding line, the control system comprising:

a source of hydraulic fluid;

a hydraulic flow divider connected to the source of hydraulic fluid;

first and second feeding lines connected at one end to a respective outlet of the hydraulic flow divider, and, at another end, to respective hydraulic actuators of the two valves, the first and second feeding lines each having a throttle and a first line connected upstream of the throttle and a second line connected downstream of the throttle;

the hydraulic flow divider comprising a hydraulically actuated hydraulic valve comprising a valve member that is slidably movable in a bore of a hydraulic valve body, the valve member being subject to a first force proportional to flow in the first feeding line, this first force acting along a first direction, and to a second force proportional to flow in the second feeding line, this second force acting along an opposite direction, wherein the first and second forces are due to hydraulic pressure acting on surfaces of the valve member and wherein the first and second forces are directly derived from pressure differences on opposite sides of first and second throttles in the first and second feeding lines.

* * * * *